US010165852B1

(12) United States Patent
Christman

(10) Patent No.: US 10,165,852 B1
(45) Date of Patent: Jan. 1, 2019

(54) TEETH CLEANING IMPLEMENT

(71) Applicant: William R. Christman, Bettendorf, IA (US)

(72) Inventor: William R. Christman, Bettendorf, IA (US)

( * ) Notice: Subject to any disclaimer, the term of this patent is extended or adjusted under 35 U.S.C. 154(b) by 0 days.

(21) Appl. No.: 15/479,982

(22) Filed: Apr. 5, 2017

Related U.S. Application Data

(60) Provisional application No. 62/318,267, filed on Apr. 5, 2016.

(51) Int. Cl.

| | |
|---|---|
| ***A46B 11/00*** | (2006.01) |
| ***A46B 9/04*** | (2006.01) |
| ***A46B 9/02*** | (2006.01) |
| ***A46B 5/00*** | (2006.01) |
| ***A46B 15/00*** | (2006.01) |

(52) U.S. Cl.
CPC ..... *A46B 11/0041* (2013.01); *A46B 5/00* (2013.01); *A46B 9/025* (2013.01); *A46B 9/04* (2013.01); *A46B 15/0091* (2013.01)

(58) Field of Classification Search
CPC ..... A46B 11/0003; A46B 11/0041; A46B 11/0062; A46B 2200/1066; A46B 2200/1086
See application file for complete search history.

(56) References Cited

U.S. PATENT DOCUMENTS 1,671,891 A 5/1928 Dolan
2,077,540 A * 4/1937 Welker ..... A46B 11/0003 15/184
2,524,412 A * 10/1950 Victor ..... A46B 11/0003 15/209.1
3,231,925 A * 2/1966 Conder ..... A46B 9/04 132/308
3,853,412 A * 12/1974 Griffin ..... A46B 11/0041 15/104.061
3,880,532 A * 4/1975 O'Hare ..... A46B 11/0041 401/186
4,059,101 A 11/1977 Richmond
4,149,815 A * 4/1979 Kawam ..... A46B 11/00 15/104.93
4,585,416 A * 4/1986 Deniro ..... A46B 1/00 15/104.93
5,366,310 A * 11/1994 Armelles Flors .. A46B 11/0003 401/132
5,711,759 A * 1/1998 Smith ..... A46B 5/023 601/139
6,602,013 B2 * 8/2003 Clark ..... A46B 9/026 401/282

(Continued)

FOREIGN PATENT DOCUMENTS

CA 2782550 A1 * 12/2013 ..... A46B 1/00

*Primary Examiner* — Jennifer C Chiang
*Assistant Examiner* — Bradley Oliver
(74) *Attorney, Agent, or Firm* — Cramer Patent & Design, PLLC; Aaron R. Cramer

(57) ABSTRACT

A teeth cleaning implement includes a deformable hollow body having a volume of dentrifice secured within a central void of the body. Bristles are secured about the outer surface of the body. A plurality of apertures in environmental communication with the central void of the body are placed about and through the outer surface of the body to permit the passage of the dentrifice.

14 Claims, 3 Drawing Sheets

(56) References Cited

U.S. PATENT DOCUMENTS

| | | | | |
|---|---|---|---|---|
| 6,722,805 | B1 * | 4/2004 | Skinner | A46B 5/04 15/167.1 |
| 7,165,907 | B2 * | 1/2007 | Levy | A46B 5/06 401/183 |
| D586,126 | S | 2/2009 | Carey, Sr. | |
| 8,584,301 | B2 | 11/2013 | Maissami | |
| 8,938,841 | B1 | 1/2015 | Ramirez | |
| 9,173,476 | B2 | 11/2015 | Fernandez | |
| 2002/0106234 | A1 * | 8/2002 | Johnson | A46B 5/06 401/134 |
| 2002/0121449 | A1 * | 9/2002 | Bowie | A46B 17/02 206/362 |
| 2003/0012594 | A1 * | 1/2003 | Andersen | A46B 11/0003 401/123 |
| 2005/0069373 | A1 * | 3/2005 | Parikh | A46B 11/0003 401/183 |
| 2005/0172435 | A1 * | 8/2005 | Bernini | A46B 5/04 15/167.1 |
| 2007/0266511 | A1 | 11/2007 | Spagnolo | |
| 2008/0014010 | A1 * | 1/2008 | Bartschi | A46B 11/0003 401/146 |
| 2011/0072605 | A1 | 3/2011 | Steur | |
| 2012/0318288 | A1 * | 12/2012 | Massimi | A46B 11/0041 132/200 |
| 2016/0008117 | A1 * | 1/2016 | Beckman | A46B 11/0041 433/1 |

* cited by examiner

TEETH CLEANING IMPLEMENT

RELATED APPLICATIONS

The present invention was first described in and claims the benefit of U.S. Provisional Application No. 62/318,267, filed Apr. 5, 2016, the entire disclosures of which are incorporated herein by reference.

FIELD OF THE INVENTION

The present invention relates generally to the field of dental hygiene products and more specifically relates to a bristle brush system.

BACKGROUND OF THE INVENTION

Oral hygiene is the practice of keeping the mouth and teeth clean to prevent dental problems, most commonly, dental cavities, gingivitis, periodontal (gum) diseases and bad breath. Teeth cleaning is the removal of dental plaque and tartar from teeth to prevent cavities, gingivitis, gum disease, and tooth decay. Severe gum disease causes at least one-third (⅓) of adult tooth loss. Tooth decay is the most common global disease. Over eighty percent (80%) of cavities occur inside fissures in teeth where brushing cannot reach food left trapped after every meal or snack and saliva or fluoride have no access to neutralize acid and remineralize demineralized teeth, unlike easy-to-clean parts of the tooth, where fewer cavities occur.

Tooth brushing is the act of scrubbing teeth with a toothbrush equipped with toothpaste. Since only two-thirds (⅔) of the outer tooth can be reached by a toothbrush, interdental cleaning (with floss or an interdental brush) can usefully accompany tooth brushing. Together, these two (2) activities are the primary means of cleaning teeth, one (1) of the main aspects of oral hygiene. Brushing teeth properly helps prevent cavities, and periodontal, or gum disease, which causes at least one-third of adult tooth loss. If teeth are not brushed correctly and frequently, it could lead to the calcification of saliva minerals, forming tartar. Tartar hardens if not removed every twenty-four hours (24 h). Poor dental health has been associated with heart disease and shortened life expectancy.

Various attempts have been made to solve problems found in dental hygiene product art. Among these are found in: U.S. Pat. Nos. 3,231,925; 1,225,955; 1,840,484; 2,103,083; and 2,165,420. These prior art references are representative of dental hygiene product systems.

None of the above inventions and patents, taken either singly or in combination, is seen to describe the invention as claimed. Thus, a need exists for a reliable teeth cleaning implement, and to avoid the above-mentioned problems.

SUMMARY OF THE INVENTION

In view of the foregoing references, the inventor recognized the aforementioned inherent problems and observed that there is a need for an implement which allows a user to place dentrifice or other teeth cleaning compound within a frangible body with bristles in order to masticate and therefore clean their teeth. In some embodiments, the sidewall of the body is thin in order to enable the implement to be used a single time; other embodiments enjoy a thicker sidewall, thereby enabling the implement to be used multiple times.

To achieve the above objectives, it is an object of the present invention to comprise such an implement having frangible, hollow body with a plurality of pores, a port enabling a user to introduce the dentrifice within the interior, a plug to seal the port, and a plurality of bristles affixed to an outer surface of the implement. In a preferred embodiment, the implement is spherical.

Another object of the present invention is to comprise the plurality of bristlers having at least one (1) first bristle and at least one (1) second bristle, where each first bristle is shorter than each second bristle.

Yet still another object of the present invention is to such a plug that maintains a continuous outer profile of the implement when the plug is fully inserted into the port. The plug preferably has a slot or similar feature to enable a driving tool to grasp and manipulate the plug to remove from the port or to seat the plug within the port.

Still another object is to provide a carrying and protective case for the implement, especially the embodiment here the implement is intended to be reused. Such a case is configured to retain the implement therein.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
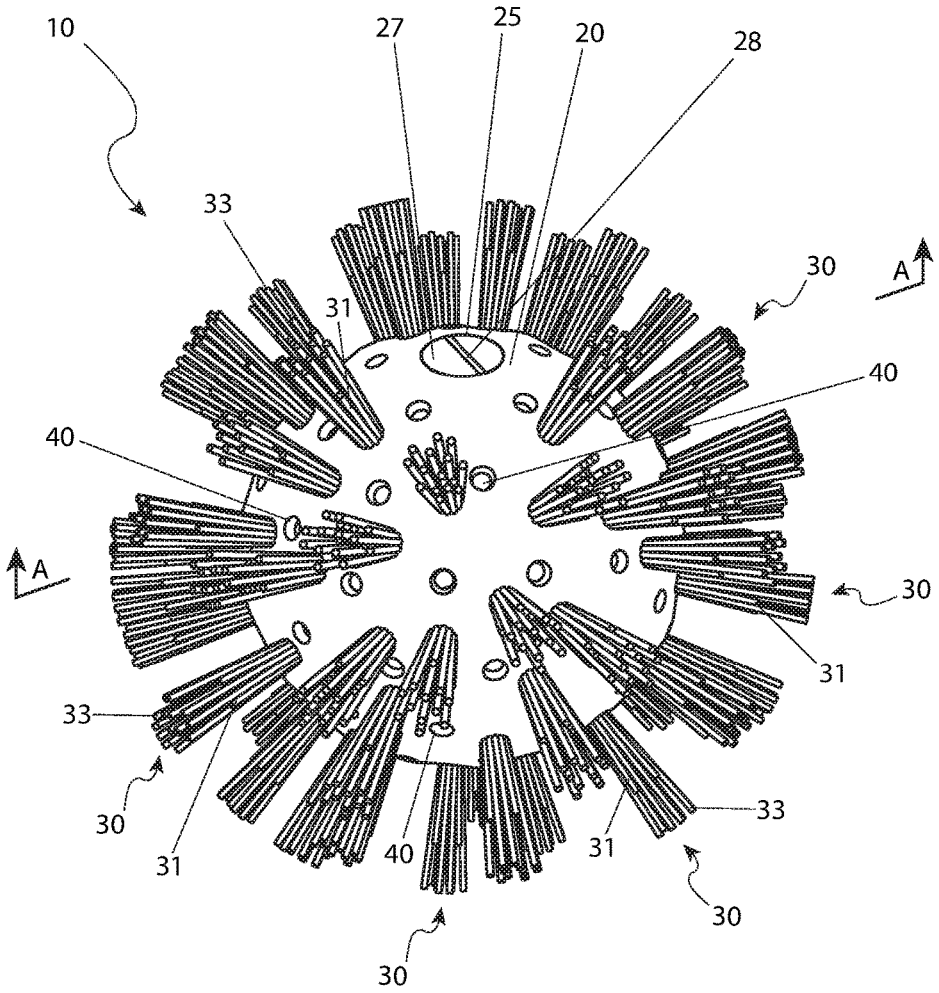
FIG. 1 is a perspective view of a teeth cleaning implement 10, according to an embodiment of the present invention; and, FIG. 2 is a perspective view of a carrying case 50 configured to retain an individual teeth cleaning implement 10 therein, according to a preferred embodiment of the present invention.

10 teeth cleaning implement
15 alternate embodiment
20 body
21 sidewall
22 alternate sidewall
25 port
27 plug
28 slot
30 bristle bundle
31 first bristle
33 second bristle
40 pore
50 case
51*a* first case half
51*b* second case half
52*a* first fastener
52*b* second fastener

DETAILED DESCRIPTION OF THE PREFERRED EMBODIMENT

The present invention is directed to a teeth cleaning implement 10. In one (1) embodiment of the present invention, the teeth cleaning implement 10 may comprise a soft gel material suitable for effective and comfortable use while being masticated by a user. Other embodiments 15 include more resilient material intended for multiple uses, or single usage only. Either embodiment is envisioned to encompass different sizes.

Referring now to the drawings, there is shown in FIG. 1 a perspective view of a teeth cleaning implement 10. In a preferred embodiment, the teeth cleaning implement 10 comprises a body 20 with a sidewall 21 fashioned as a spherical shape with an inner volume for housing toothpaste or other types of dentrifice. The outer surface of the sidewall 21 comprises a plurality of bristle bundles 30 affixed thereto. The sidewall 21 also has a plurality of pores 40 spaced between the bristle bundles 30 such that the toothpaste or dentrifice may transfer from inside the body 20 to the mouth of the user. The sidewall 21 is of a material enabling a user to deform the implement 10, thereby forcing dentrifice to emanate from the interior through the pores 40. The bristle bundles 30 are affixed to the sidewall 21 and randomly disposed thereabout. The bristle bundles 30 extend outwardly from the body 20 and are used to clean a user's teeth while moving throughout a user's mouth. The bristle bundles 30 are designed to move throughout the user's mouth and help with brushing. Brushing helps remove food and plaque, a sticky film of bacteria that can irritate the gums. It is appreciated that the amount of bristle bundles 30, as well as the location of them and the extent to which they extend outward, can be varied. In at least one (1) embodiment, each bristle bundle 30 comprises a plurality of first bristles 31 and a plurality of second bristles 33. The first bristles 31 each comprises an extended length, relative to the body 30, lesser than that of each of the second bristles 33.

The body 20 may be spherical or may be another geometrical shape. The body 20 comprises an inner volume and an outer surface. The inner volume is able to be filled with a substance such as toothpaste or other dentrifice through a port 25. The port 25 preferably has plug 27 that seals the port 25. In a preferred embodiment, the plug 27, when fully seated in the port 27, maintains a continuous outer profile with the body 20. The plug 27 preferably comprises a slot 28 or other means to grasp and threadably or otherwise remove the plug 27 from the port 25. The alternate sidewall 22 comprises durable material that allows the alternate embodiment 15 to realize longevity in use, or preferably the sidewall 21 comprises an inexpensive synthetic material suitable for one-time use. The dentrifice used can be of a type suitable for consumption. The exact specifications, materials used, and method of use of the teeth cleaning implement 10, 15 may vary upon manufacturing.

Figure 2:
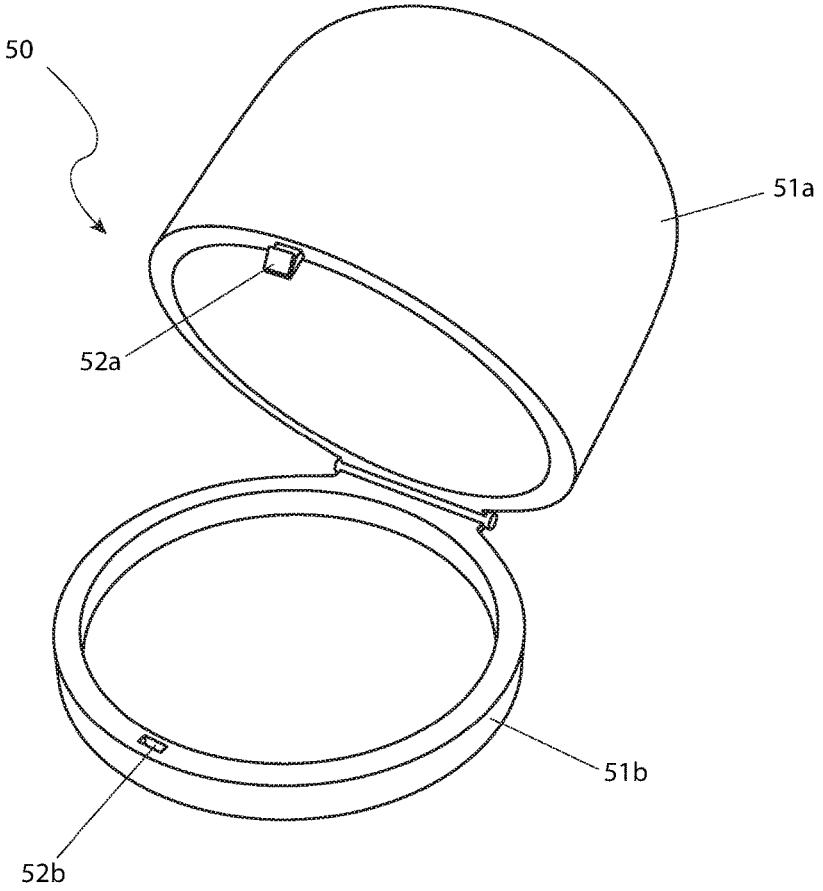

Referring now to FIG. 2, a carrying case 50 is provided that is configured to securely retain the implement 30 therein. The case 50 has a first case half 51*a* and a second case half 51*b* hingedly connected at corresponding sides thereof. On the sides opposing the hinged connection, the first case half 51*a* has a first fastener 52*a* that is removably securable to a second fastener 52*b* of the second case half 51*b*.

Figure 3A:
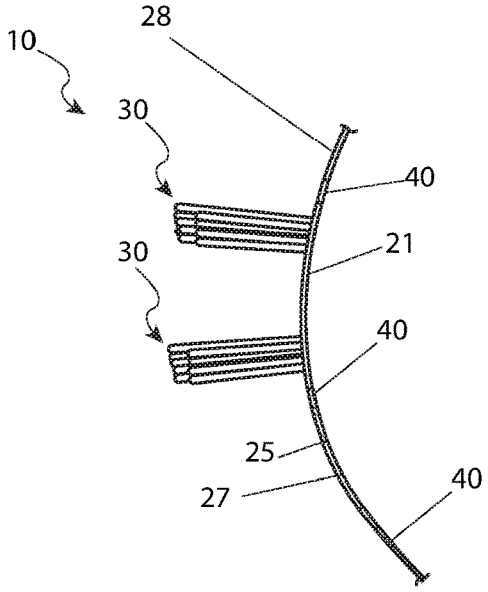
FIG. 3A is a cross-sectional view (taken along the line A-A of FIG. 1), according to a preferred embodiment of the present invention; and, FIG. 3B is a cross-sectional view (taken along the line A-A of FIG. 1), according to an alternate embodiment 15 of the present invention.
Figure 3B:
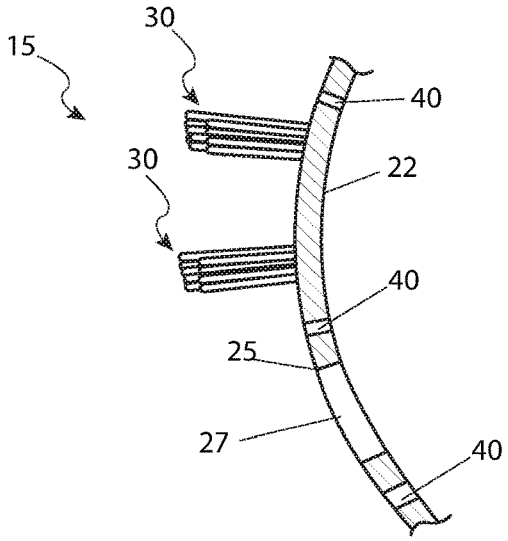

Referring now to FIGS. 3A and 3B, sectional views of the preferred embodiment 10 and alternate embodiment 15, respectively, are herein described. As can be seen in FIG. 3*a*, the sidewall 21 has a thickness enabling limited use of the preferred embodiment 10. In FIG. 3*b*, the alternate sidewall 22 has a much larger thickness, thereby enabling the alternate embodiment 15 to be reused many more times than the preferred embodiment 10. The alternate sidewall 22 incorporates a resilient synthetic material capable of withstanding repeated use. All other features are identical between the preferred embodiment 10 and the alternate embodiment 15.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A teeth cleaning implement, comprising:
- a hollow, frangible body, having an outer surface and an interior;
- a plurality of bristle bundles attached to said outer surface and extending outwardly therefrom;
- a plurality of pores disposed about said body, capable of providing fluid communication between an environment and said interior;
- a port located on said outer surface, capable of providing fluid communication with said interior; and,
- a plug removably insertable into said port;
- wherein said interior is capable of receiving an amount of a substance therein.

2. The implement of claim 1, wherein said body is spherical.

3. The implement of claim 1, wherein said plurality of bristle bundles each further comprises:
- at least one first bristle; and;
- at least one second bristle;
- wherein a length of each first bristle is lesser than a length of each second bristle.

4. The implement of claim 1, wherein said plug, when fully inserted into said port, maintains a continuous outer profile with said body.

5. The implement of claim 4, wherein said plug further comprises a slot capable of receiving a driving member to manipulate said plug relative to said body.

6. The implement of claim 1, wherein said body comprises a synthetic material suitable for single usage.

7. The implement of claim 6, wherein said resilient synthetic material is a soft gel material.

8. A kit, comprising:
- a teeth cleaning implement, comprising:
  - a hollow, frangible body, having an outer surface and an interior;
  - a plurality of bristle bundles attached to said outer surface and extending outwardly therefrom;
  - a plurality of pores disposed about said body, capable of providing fluid communication between an environment and said interior;
  - a port located on said outer surface, capable of providing fluid communication with said interior; and,
  - a plug removably insertable into said port; and,
- a case configured to retain said implement therein, comprising a pair of case halves each having a first side hinged connection and a single securing fasteners located at a second side;
- wherein said interior is capable of receiving an amount of a substance therein.

9. The implement of claim 8, wherein said body is spherical.

10. The implement of claim 8, wherein said plurality of bristle bundles each further comprises:

at least one first bristle; and;

at least one second bristle;

wherein a length of each first bristle is lesser than a length of each second bristle.

11. The implement of claim 8, wherein said plug, when fully inserted into said port, maintains a continuous outer profile with said body.

12. The implement of claim 11, wherein said plug further comprises a slot capable of receiving a driving member to manipulate said plug relative to said body.

13. The implement of claim 8, wherein said body comprises a synthetic material suitable for single usage.

14. The implement of claim 13, wherein said resilient synthetic material is a soft gel material.

* * * * *